United States Patent [19]

Uchiyama

[11] 4,077,293

[45] Mar. 7, 1978

[54] SAMPLE HOLD ARRANGEMENT FOR A KEY SIGNAL IN AN ELECTRONIC MUSICAL INSTRUMENT

[75] Inventor: Shigeru Uchiyama, Omiya, Japan

[73] Assignee: Kabushiki Kaisha Kawai Gakki Seisakusho, Hamamatsu, Japan

[21] Appl. No.: 727,238

[22] Filed: Sep. 27, 1976

[30] Foreign Application Priority Data

Sep. 29, 1975 Japan ..... 50-116339
Jun. 30, 1976 Japan ..... 51-76585

[51] Int. Cl.[2] ..... G10H 1/00; G10H 5/02

[52] U.S. Cl. ..... 84/1.01; 84/DIG. 2; 84/DIG. 8; 84/DIG. 10; 84/DIG. 20; 84/DIG. 23

[58] Field of Search ..... 84/1.01, DIG. 2, DIG. 8, 84/DIG. 10, DIG. 20, DIG. 23

[56] References Cited

U.S. PATENT DOCUMENTS

| | | | |
|---|---|---|---|
| 3,801,721 | 4/1974 | Bunger | 84/DIG. 2 |
| 3,828,110 | 8/1974 | Colin | 84/1.01 |
| 3,872,764 | 3/1975 | Munch, Jr. et al. | 84/1.01 |
| 3,902,392 | 9/1975 | Nagahama | 84/1.01 |
| 4,012,980 | 3/1977 | Suzuki | 84/1.01 |

*Primary Examiner*—Stanley J. Witkowski
*Attorney, Agent, or Firm*—Haseltine, Lake & Waters

[57] ABSTRACT

A sample hold arrangement for a key signal in an electronic musical instrument in which a keyboard circuit generates a voltage corresponding to a depressed key. The keyboard circuit is connected at its output terminal to an input terminal of a comparator. An output terminal of the comparator is connected to a memory capacitor and a buffer circuit through two gates connected in a series with one another. An output terminal of the buffer circuit is connected, in turn, to a second input terminal of the comparator, and one of the two gates is connected with its control electrode to a detection circuit. A circuit closing signal is generated by the detection circuit when the potentials of the two input terminals of the comparator become substantially equal. The other one of the two gates is connected with its control electrode to an output terminal of a keying signal generator which generates a keying signal of the keyboard circuit.

3 Claims, 12 Drawing Figures

AMPLIFIER
FILTER
OSCILLATOR
SIGNAL GENERATOR
VCA
VCF
VCO
ADSR
+V
-V
1
1a
2
3
3a
4
5
6
7
8
10
11
11a
12
13
14
15
16
17
18

KEY ON
KEY OFF

VIN
+E
+V
-V

KEY ON
KEY OFF
OUTPUT OF BUFFER CIRCUIT 27
V2
0
-V
b

INPUT OF SECOND GATE
SECOND GATE ON
SECOND GATE OFF
TIME OF CHARGING INTO MEMORY CONDENSER

+V0
-V0
OUTPUT OF WINDOW COMPARATOR

+V0
V3
-V0
OUTPUT OF DELAY CIRCUIT
c
V3'

FIRST GATE ON
INPUT OF FIRST GATE
FIRST GATE OFF t (DELAY TIME FROM SECOND GATE OFF)
V2
V1
a
OUTPUT OF BUFFER CIRCUIT 32

SAMPLE HOLD ARRANGEMENT FOR A KEY SIGNAL IN AN ELECTRONIC MUSICAL INSTRUMENT

BACKGROUND OF THE INVENTION

This invention relates to a sample hold apparatus for a key signal in an electronic musical instrument.

An apparatus of this kind as already known in the art is shown in FIG. 1. A keyboard circuit 1, which generates a voltage corresponding to a depressed key, is connected at its output terminal 1a to an input terminal of a comparator 2. An output terminal of the comparator 2 is connected to a memory condenser 4 and a buffer circuit 5 through a gate 3. An output terminal of the buffer circuit 5 is connected to another input terminal of the comparator 2. The keyboard circuit 1 is so constructed that a plurality of series resistances 8, 8 . . . are connected in series to an electric power source terminal 6 through a constant-current circuit 7, and a plurality of keyswitches 10,10 . . . which are closed by depression of respective keys and are connected to respective connecting points of the resistances 8,8 . . . These key-switches 10,10 . . . are connected together at their movable contacts and are connected in common to the output terminal 1*a*. Key-switches 11,11 . . . for generating respective keying signals are located on one side of the key-switches 10,10 . . . . These key-switches 11, 11 . . . are connected together at their stationary contacts and connected in common to an electric power source terminal 12. They are also connected together at their movable contacts and connected in common to a control electrode 3a of the gate 3. The output terminal of the buffer circuit 5 is also connected to a voltage-controlled oscillator 13 (hereinafter called "VCO 13"). An output terminal thereof is connected to a speaker 17 through a voltage-controlled filter 14 (hereinafter called "VCF 14"), a voltage-controlled amplifier 15 (hereinafter called "VCA 15") and an amplifier 16.

Additionally, a single common output terminal 11a of the foregoing key-switches 11, 11 . . . is connected to control electrodes of the VCF 14 and the VCA 15 through an envelope signal generating circuit 18 (hereinafter called "ADSR 18").

Thus, if a key is depressed, a voltage corresponding to the depressed key is generated at the output terminal 1a of the keyboard circuit 1 and a keying signal is obtained at the common output terminal 11a of the key-switches 11, 11 . . . . The individual key switches 10 and 11 are ganged. As a result, the gate 3 is opened and the memory condenser 4 is charged so that the two input terminals of the comparator 2 may become equal in potential, and the VCO 13 oscillates with a frequency corresponding to an output voltage of the buffer circuit 5. Meanwhile, the foregoing keying signal drives the ADSR 18 so that an output signal thereof may control the VCF 14 and the VCA 15, and as a result a musical tone signal having an envelope is obtained from the speaker 17.

The ADSR 18, as is well known, generates a voltage waveform A (an envelope signal) as shown in FIG. 2. As will be clear from this waveform A, it has a release time beginning at the moment when the key is released (key off), and thus the musical tone becomes a natural attentuated one. In view of this fact, it is thought necessary that the memory condenser 4 is kept at a properly or charged potential even after the key is released. Accordingly, to achieve this, the key-switches 10, 10 . . . and 11,11 . . . must be set so that when the key depression is released, the key-switches 11,11 . . . are opened earlier than the key-switches 10,10 . . . . Additionally, in this case, the time difference between the key-switches 10,10 . . . and the key-switches 11,11 . . . must be as small as possible, for instance, less than the ratio in which the numerator is 1 and the denominator is several tenths of a sec. Such a setting, however, is extremely difficult, and it often happens that the time difference becomes too large or becomes zero or the key-switches 10,10 . . . are opened earlier. As a result, therefore, the musical tone is deformed.

It is therefore an object of the present invention to provide an arrangement which is free of the disadvantages described above.

Another object of the present invention is to provide an arrangement of the foregoing character, which is simple in construction and may be economically maintained in service.

A further object of the present invention is to provide an arrangement, as described, which has a substantially long operating life.

SUMMARY OF THE INVENTION

The objects of the present invention are achieved by providing a keyboard circuit which generates a voltage corresponding to a depressed key and is connected at its output terminal to an input terminal of a comparator. An output terminal of the comparator is connected to a memory condenser and a buffer circuit through two gates connected in series one to another. An output terminal of the buffer circuit is connected to another input terminal of the comparator, and one of the two gates is connected at its control electrode to a detection circuit which generates a circuit closing signal when the two input terminals of the foregoing comparator become substantially equal in potential. The other one of the two gates is connected at its control electrode to an output terminal of a keying signal generator which generates a keying signal by an output signal of the keyboard circuit.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 3:
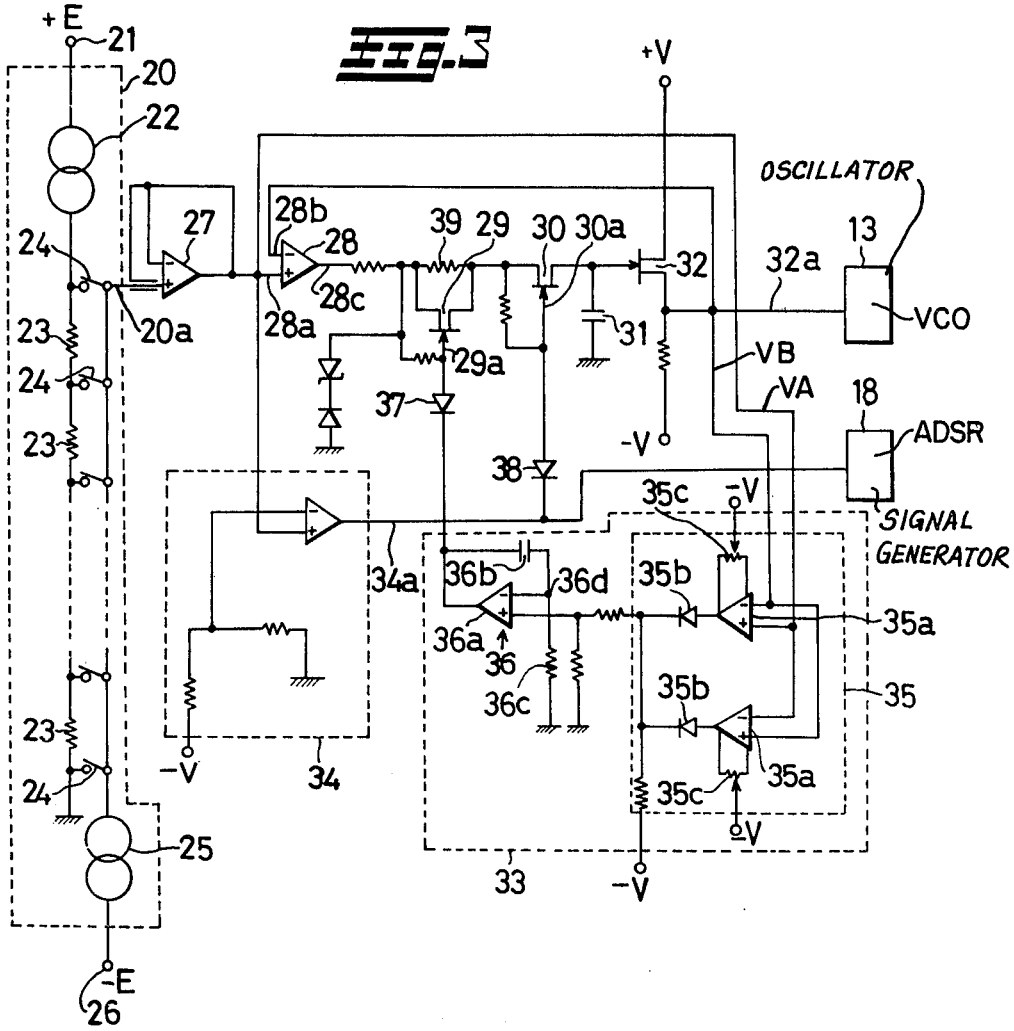
FIG. 3 is an electrical circuit diagram and shows one embodiment of the present invention.

Referring to the drawings, FIG. 3 shows one embodiment of the present invention in which reference numeral 20 denotes a keyboard circuit which is so constructed that when a key is depressed, a voltage corresponding to that key is generated, and this keyboard circuit 20 comprises: multiple resistances 23,23 . . . connected in a series through a constant current circuit 22 to one polarity, that is, a positive polarity 21 of a power source; plural key-switches 24,24 . . . connected to respective connecting points of respective resistances 23,23 . . . ; and these key-switches 24,24 . . . are connected together at one side contacts thereof and are connected in common through a constant-current circuit 25 to another polarity, that is a negative polarity 26 of the power source. An output terminal 20a is directed out from one extreme of the series key-switches 24,24 . . . . This output terminal 20*a* is connected to a buffer circuit 27. An output terminal of the buffer circuit 27 is connected to an input terminal 28*a* of a comparator 28, and an output terminal 28*c* thereof is connected to a charging memory condenser 31 and a buffer circuit 32 through a first gate 29 and a second gate 30. An output terminal 32*a* of the buffer circuit 32 is connected to another input terminal 28*b* of the comparator 28. The two input terminals 28*a*,28*b* of the comparator 28 are connected to a control electrode 29*a* of the first gate 29 through a detection circuit 33 and a diode 37. The latter is so arranged that a circuit closing signal is generated when the two input signals to the input terminals 28*a*,28*b* become nearly equal. The output terminal of the buffer circuit 27 is, furthermore, connected to a keying signal generator 34, and an output terminal 34*a* thereof is connected to a control electrode 30*a* of the second gate 30 through a diode 38.

Figure 1:
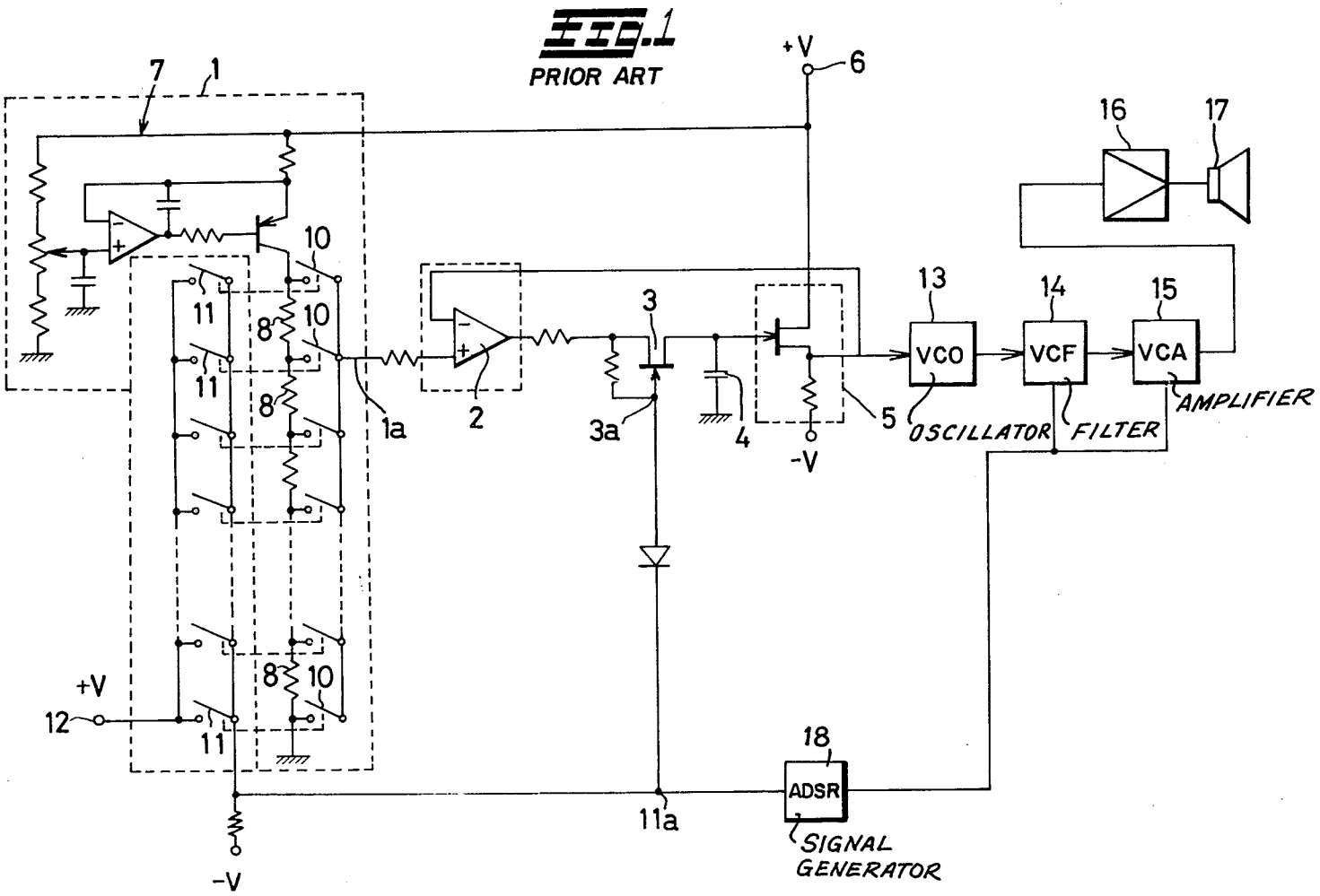
FIG. 1 PRIOR ART
FIG. 1 is a schematic circuit diagram of a conventional apparatus.

Similarly to that shown in FIG. 1, the output terminal 32*a* of the buffer circuit 32 is also connected to the VCO 13, and the output terminal 34*a* of the keying signal generator 34 is connected to the ADSR 18.

The buffer circuit 27, the comparator 28 and the keying signal generator 34 each comprises an operational amplifier and the first gate 29, the second gate 30 and the buffer circuit 32 each comprises a FET. The detection circuit 33 comprises a window comparator 35 and a delay circuit 36. The window comparator 35 comprises two operational amplifiers 35*a*,35*a* and an OR circuit composed of two diodes 35*b*,35*b* connected to output terminals thereof. It is so arranged that $-V$ is generated when input voltages $V_A$,$V_B$ at the two operational amplifiers 35*a*,35*a* have a relationship of $|V_A - V_B| < \Delta V$, and $+V$ is generated when they have a relationship of $|V_A - V_B| > \Delta V$. The $\Delta V$ is an offset voltage given by adjustment of potentiometers 35*c*,35*c* and is a value approximating zero. The delay circuit 36 is an integration circuit comprising an OP AMP 36*a*, a resistance 36*b* interposed between an input terminal 36*d* and an output terminal thereof, and a resistance 36*c* interposed between the input terminal 36*d* and the ground. Reference numeral 39 denotes a resistance provided in parallel with the first gate 29.

Figure 2:
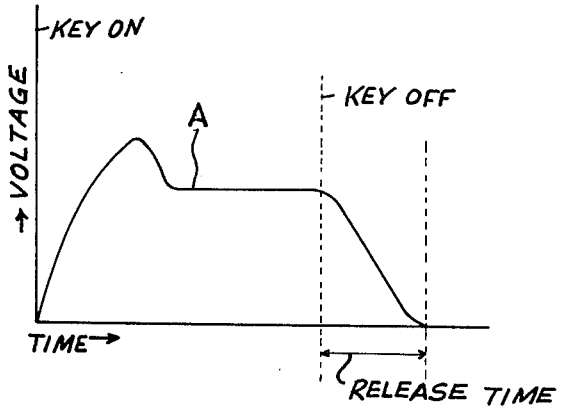
FIG. 2 is a waveform diagram showing an example of an envelope signal, generated from an ADSR.
Figures 4A, 4B, 4C, 4D, 4E, 4F:
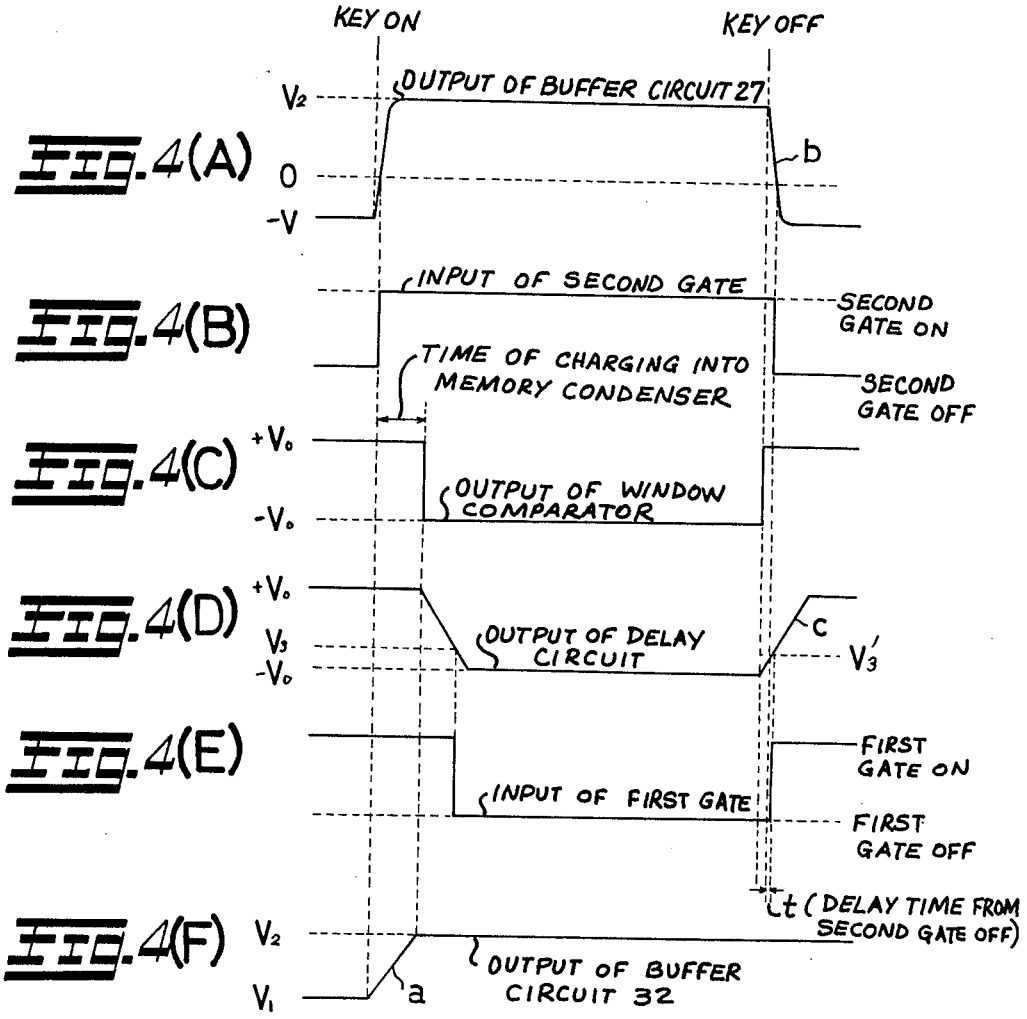
FIGS. 4(A) to 4(F) show waveform diagrams of signal at various circuit points in the arrangement of FIG. 3.

If, thus, a key is depressed, a voltage corresponding to the key and depending on the resistance 23 is obtained at the output terminal 20*a* and is applied to one input terminal of the buffer circuit 27. An output signal thereof is fed back to the other input terminal connected to its own output terminal, and a voltage at the output terminal changes from -V to $V_2$ wth a slope as shown in FIG. 4(A). When this curve's(leading edge)passes through the zero level, an output of the keying signal generator 34 changes from a negative potential to a positive potential, and an output signal as shown in FIG. 4(B) is obtained and applied as an input to the second gate 30. As a result the second gate 30 is opened and at the same time the ADSR 18 is driven to generate an envelope signal as shown in FIG. 2. Meanwhile, as will be explained in detail below, the output terminal of the detection circuit 33 shows $+V_O$ as shown in FIG. 4(D) and the first gate 29 is kept open, so that an output signal of the comparator 28 is applied to the memory condenser or capacitor 31 through the first gate 29 and the second gate 30. Thus, as its applied voltage is increased, an output of the buffer circuit 32 is increased, and when the potential difference $V_A$-$V_B$ of the two input terminal 28a,28a of the comparator 28 becomes $|V_A - V_B| < \Delta V$, an output voltage of the window comparator 35 becomes $-V_O$ as shown in FIG. 4(C). Consequently, a voltage of the output terminal of the delay circuit 36 decreases to reach $-V_O$ as shown in FIG. 4(D). When its declination passes through a point $V_3$ on its way to $-V_O$, the first gate 29 is closed, as shown in FIG. 4(E). Thus, until the first gate 29 is closed, and at a time instant or thereafter when the window comparator 35 operates, the voltages of the two input terminals 28*a*,28*a* of the comparator 28 become equal to one another, and the condenser or capacitor 31 is charged to such a level that the buffer circuit 32 can generate the voltage corresponding to the depressed key. The output voltage of the buffer circuit 32 reaches $V_2$ while being changed along a slope a as shown in FIG. 4(F), and a musical tone is changed into that corresponding to the depressed key.

If the depressed key is released after the lapse of a certain time, the input to the buffer circuit 27 becomes zero, so that the output voltage thereof is lowered along a line *b* as shown in FIG. 4(A), and the output of the comparator 28 and that of the keying signal generator 34 are also lowered, and the second gate 30 is closed as shown in FIG. 4(B).

At the initial stage of the trailing edge b in FIG. 4(A), the input of the window comparator 35 becomes $|V_A - V_B| > \Delta V$, and at the moment when the depressed key is released, its output changes to $+V_O$ as shown in FIG. 4(C). The output of the delay circuit 36 is increased from that moment along an inclination line c as shown in FIG. 4(D). When this line *c* passes through a point $V_3'$, as shown in FIG. 4(E), the first gate 29 is opened lagging by a time *t* behind second gate 30.

Thus, when the key is depressed, the condenser or capacitor 31 is charged through the first and the second gates 29,30, and the first gate 29 is closed at the time of completion of charging. Therefore, the condenser or capacitor 31 can be maintained in its appropriate charged condition even after the depressed key is released and a correct musical tone can be generated until an envelope signal generated from the ADSR 18 ends.

Figures 5, 6:
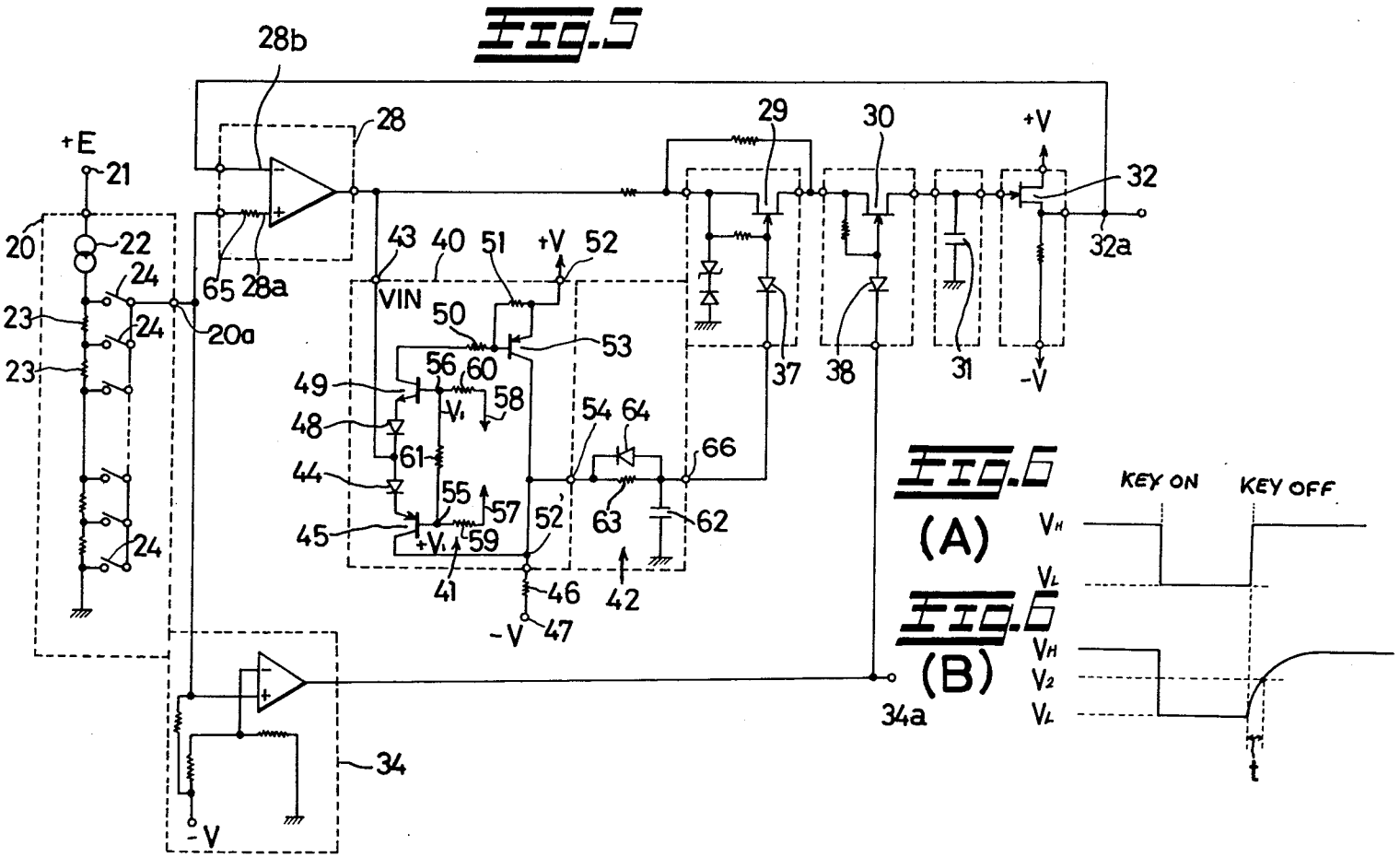
FIG. 5 is an electrical circuit diagram and shows another embodiment of the present invention.
FIG. 6 (A) is a waveform diagram of the output signal of the circuit diagram 41 of FIG. 5, and FIG. 6 (B) is a waveform diagram of the output signal of the circuit diagram 42 of FIG. 5.

FIG. 5 shows another embodiment of the present invention. In this Figure, the same parts as those in FIG. 3 are designated by the same reference numerals. A detection circuit 40 is connected to the output terminal of the comparator 28, and an output terminal thereof is connected to the control electrode of the first gate 29. The detection circuit 40 comprises a window comparator 41 and a delay circuit 42. The window comparator 41 is different in type from that shown in FIG. 3. It is so constructed that an input terminal 43 thereof is connected to a negative power source terminal 47 through the forward path of first diode 44, a first transistor 45 and a first resistance 46. It is also connected to a positive power source terminal 52 through the reverse path of second diode 48, a second transistor 49 and second and third resistances 50,51. A third transistor 53 is connected at its collector to a connecting point 52' between the first transistor 45 and the first resistance 46, as well as the positive power source terminal 52 through its emitter. An output terminal 54 is taken from the above collector. Its base is connected to a connecting point between the second and the third resistances 50,51. The bases of the first and the second transistors 45,49 are formed to be input terminals 55,56 for standard voltages. The standard voltages $+V_1, -V_1$ are applied thereto by having the voltage $+V$, $-V$ at the power source terminals 57,58 divided through resistances 59,60,61.

The standard voltages $+V_1, -V_1$ should be determined by taking into consideration voltage drops between the bases and the emitters of the first and the second transistors 45,49 and voltage drops in the first and the second diodes 44,48. However, this is not required here, and the voltages $+V_1, -V_1$ may be considered as the standard voltages.

Thus, when an input voltage $V_{IN}$ applied to the input terminal 43 conforms to condition $+V_1 > V_{IN} > -V_1$, the first and the second transistors 45,49 are non-conductive and therefore the third transistor is also non-conductive, so that the voltage $-V$ of the negative power source terminal 47 is taken out through the resistance 46 from the output terminal 54. (This output voltage will hereinafter be called "$V_L$".)

If, then, it is changed to a condition of $V_{IN} > -V_1$, the second transistor 49 becomes non-conductive and the first transistor 45 becomes conductive, so that the voltage at the output terminal 54 becomes such a voltage $V_{H1}$ that voltage drop values of the first diode 44 and the first transistor 45 are subtracted from the $V_{IN}$.

If, then, it is changed into a condition of $V_{IN} > -V_1$, the first transistor 45 becomes non-conductive and the second transistor 49 becomes conductive, so that the voltage at the output terminal 54 becomes such a voltage $V_{H2}$ that a voltage drop value of the third transistor 53 is subtracted from the voltage $+V$ at the positive power source terminal 52. The voltages $V_{H1}, V_{H2}$ are nearly equal to one another and each thereof will hereinafter be called "$V_H$".

The delay circuit 42 comprises a condenser or capacitor 62, a resistance 63 and a diode 64, and operates in the following manner: When an output of the comparator 41 is obtained as shown in FIG. 6(A), an output of the delay circuit 42 becomes as shown in FIG. 6(B), so that the first gate 29 is closed with a time delay, *t*. In this embodiment, the buffer circuit 27 is omitted and a resistance 65 is interposed.

Assume a condition that the memory condenser 31 is already charged to a certain potential and an output voltage Vout of the buffer circuit 32 is applied to the input terminal 28b of the comparator 28. Then, if any desired key is depressed, a voltage $V_x$ corresponding to the key is generated from the keyboard circuit 1 and is applied to the comparator 28.

In this operation, there are three conditions as listed below, though they also are present in the embodiment of FIG. 3.

(1) $V_x >$ Vout (2) $V_x <$ Vout (3) $V_x =$ Vout

Each of these occasions will be explained as follows:--

(1) $V_x >$ Vout

In this condition, the $V_{IN}$ (+ 15V, for instance) is generated from the comparator 28. Between this output $V_{IN}$ and the standard voltages $+V_1$, $-V_1$ of the comparator 40, there is a condition $V_{IN} > |V_1|$., so that an output of the comparator 40 becomes $V_H$ (+ 15V) as shown in FIG. 6(A). As a result, the first gate 29 is kept open, and the second gate 30 is made conductive by a keying signal generated from the keying signal generator 34 simultaneously with depression of the selected key-switch 24. Accordingly, the output of the comparator 28 is charged to the memory condenser or capacitor 31. When, by this charge, the output Vout of the buffer circuit 32 is fed back to the comparator 28 and $V_x =$ Vout is obtained, the output $V_{IN}$ of the comparator 28 is brought into a condition $V_{IN} > |V_1|$., and the output of comparator 40 becomes $V_L$ (− 15V) as shown in FIG. 6(A). An output of the delay circuit 42 becomes as shown in FIG. 6(B), so that the first gate 29 is closed, and the condenser or capacitor 31 is maintained at its charged potential for keeping the $V_x =$ Vout.

(2) $V_x >$ Vout

In this condition, the output of the comparator 28 becomes $V_{IN}$ (− 15V), and the output of the window comparator 40 becomes $V_H$ (+ 15V) as shown in FIG. 6. As a result the first gate 29 becomes conductive and the second gate 30 becomes conductive by a keying signal. Accordingly, the charged potential of the condenser 31 is discharged through the first and the second gates 29,30. When the condition $V_x =$ Vout is established, in almost the same manner as in case of (1), the first gate 29 is closed and there remains in the memory condenser or capacitor 31, the charged potential to maintain the relation of $V_x =$ Vout.

(3) $V_x =$ Vout

This condition is identical with the case where $V_x =$ Vout in each of the above conditions (1), (2), and the condition remains as is.

If, then, the depressed key is released and the key-switch 24 is opened, an output signal of the keying signal generator 27 disappears at that moment and the second gate 30 is closed. At the same time the output of the comparator becomes $V_{IN}$ (− 15V), whereby the output of the comparator 40 becomes $V_H$ as shown in FIG. 6(A). Accordingly, when the output delayed by the time *t* through delay circuit 42 as shown in FIG. 6(B), reaches $V_2$, the first gate 29 is opened.

Thus, at the moment of closing of the key-switch 24, the memory condenser or capacitor 31 is rapidly charged through the first and the second gates 29,30 so as to achieve the condition of $V_x =$ Vout. When this condition of $V_x =$ Vout is established, the first gate 29 is closed. If, then, the key-switch 24 is opened, the second gate 30 is closed at that instant, and the first gate 29 is opened with a delay. It is thereby prepared for the next operation when the key-switch 24 is closed.

In the embodiment as shown in FIG. 3, it is necessary that the comparator 35 has a high accuracy because $\Delta V$ must be as close to zero as possible. Accordingly, it becomes costly because the two operational amplifiers of high accuracy are used. In the embodiment of FIG. 5, the comparator 41 may be acceptable if it can discriminate whether the output of the comparator 28 is between the standard voltages or not, and accordingly it becomes low in cost because accuracy as required for the foregoing comparator 35 is not required.

Thus, according to the present invention, it is so arranged that when a key is depressed, a condenser is charged through first and second gates, and on completion of the charge thereof, the first gate is closed, so that the condenser can always be maintained at its appropriate charge even after the depressed key is released. A VOC keeps a correct frequency oscillation, and a correct musical tone can be generated until an envelope signal generated from an ADSR ends, and there do not occur the various problems as in the foregoing case where key-switches are provided in ganged form.

Without further analysis, the foregoing will hopefully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalents of the following claims.

What is claimed is:

1. A sample hold arrangement for a key signal in an electronic musical instrument comprising: depressable keys; a keyboard circuit for generating a voltage corresponding to a depressed key; a comparator with a first input terminal connected to an output terminal of said keyboard circuit; a memory capacitor; a buffer circuit; and two gates; an output terminal of said comparator being connected to said memory capacitor and said buffer circuit through said two gates; said gates being connected in series; said buffer circuit having an output terminal connected to a second input terminal of said comparator; a detection circuit; one of said two gates being connected at a control electrode thereof to said detection circuit; a keying signal generator connected to the output of said keyboard circuit for generating a keying signal of said keyboard circuit, said detection circuit generating a circuit closing signal when potentials of said two input terminals of said comparator become substantially equal; the other one of said two gates being connected at a control electrode thereof to an output terminal of said keying signal generator.

2. A sample hold arrangement as defined in claim 1 wherein said detection circuit comprises a window comparator connected to the two input terminals of said-mentioned comparator; and a delay circuit connected to an output terminal thereof.

3. A sample hold arrangement as defined in claim 1 wherein said detection circuit comprises a window comparator connected to the output terminal of said first-mentioned comparator; and a delay circuit connected to an output terminal of said window comparator.

* * * * *